United States Patent [19]

Miller et al.

[11] 4,427,159

[45] Jan. 24, 1984

[54] HOLDER FOR SPARE TOILET TISSUE

[76] Inventors: George W. Miller, c/o George Spector, 3615 Woolworth Bldg., 233 Broadway; George Spector, c/o George W. Miller, 3615 Woolworth Bldg., 233 Broadway, both of, New York, N.Y. 10007

[21] Appl. No.: 291,304

[22] Filed: Aug. 10, 1981

[51] Int. Cl.[3] ..... B65H 19/04

[52] U.S. Cl. ..... 242/55.3; 242/55.53

[58] Field of Search ..... 242/55.2, 55.3, 55.53, 242/55.54, 129.5, 129.6; 211/123, 124, 204; D6/97

[56] References Cited

U.S. PATENT DOCUMENTS

| | | | |
|---|---|---|---|
| D. 204,595 | 5/1966 | Turro | D6/97 D |
| 1,981,673 | 11/1934 | Smith | 242/55.2 |
| 2,561,584 | 7/1951 | McDonald | 242/55.53 |
| 2,790,608 | 4/1957 | Sieven | 242/55.3 |
| 3,140,060 | 7/1964 | Layton et al. | 242/55.53 |
| 3,291,354 | 12/1966 | Ziebarth | 225/79 |
| 3,584,802 | 6/1971 | Sieber | 242/55.3 |

*Primary Examiner*—Leonard D. Christian

[57] ABSTRACT

A holder for an extra roll of tissue in a wash room, so to be readily available in case the other roll of tissue is used up, the holder including a wire frame hung from the spindle of the conventional tissue roll holder, a second spindle supported on the frame, and a pivotable cover on the frame for hiding the spare tissue roll from view.

1 Claim, 4 Drawing Figures

Fig. 1
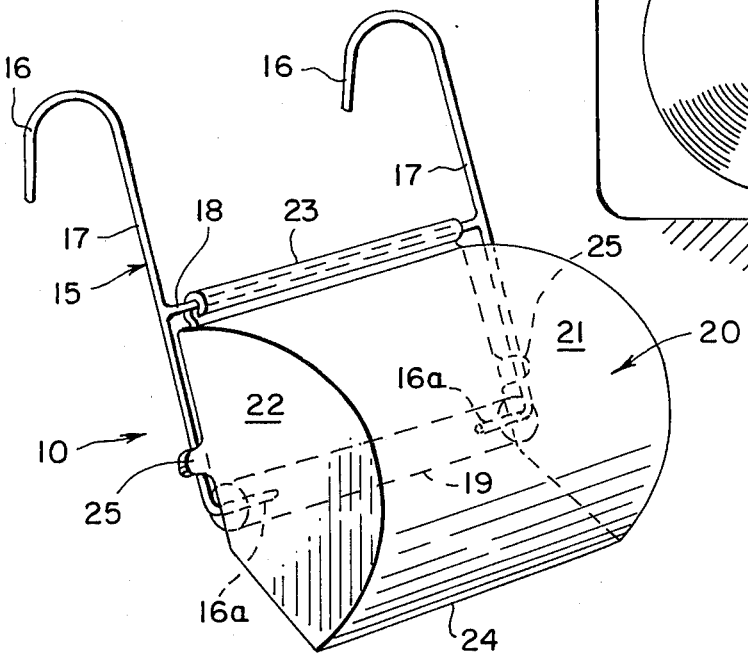
Fig. 2
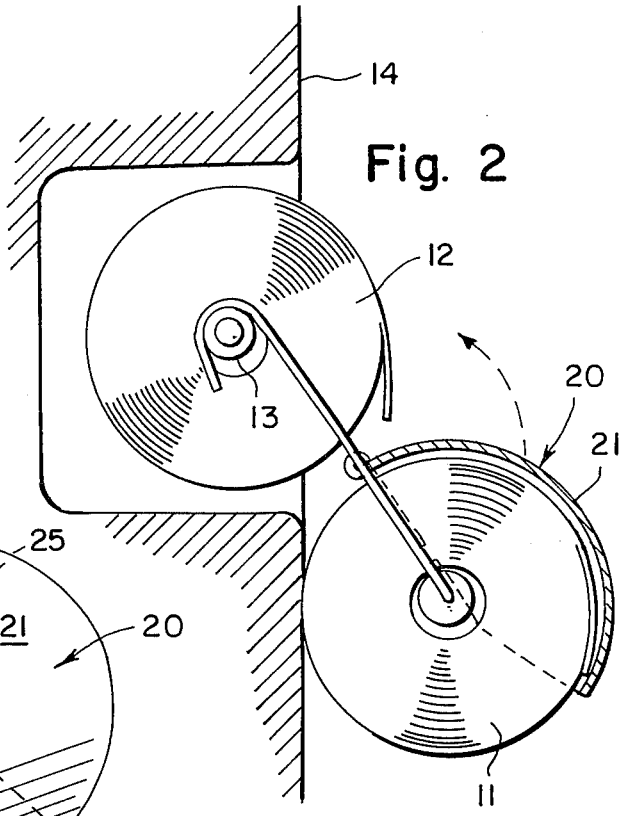
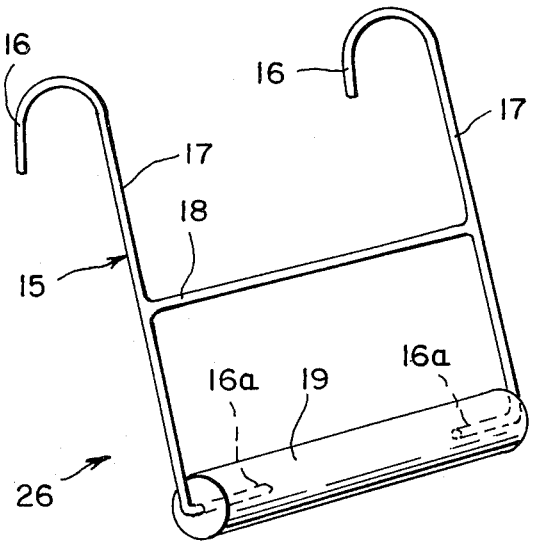
Fig. 3
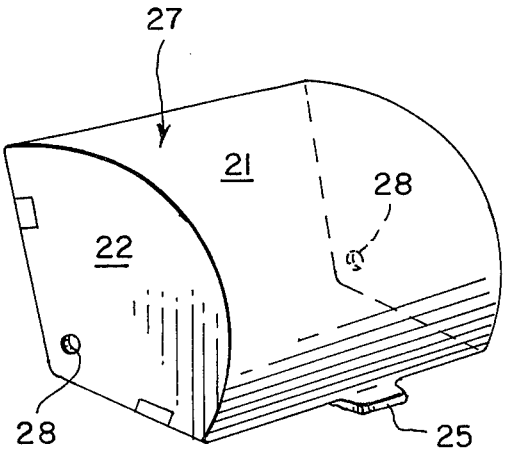
Fig. 4

HOLDER FOR SPARE TOILET TISSUE

This invention relates generally to wash room equipment.

It is well known that upon occassion, a person seated on a toilet, finds himself without toilet paper being available, when the roll suddenly runs out of supply. This happens particularly if no extra roll of tissue is nearby, such as sometimes happens where such extra roll is regarded as unsightly in view. This situation is objectionable and is therefore in need of an improvement.

Accordingly, it is a principal object of the present invention, to provide a holder for a spare toilet tissue which allows an extra roll to be conveniently placed near the conventional roll which is being used, and which is hidden from view so to not be objectionable to the view of a washroom decor.

Another object is to provide a holder for a spare toilet tissue and which eliminates the need of hiding spare tissue in a cabinet that cannot be conveniently reached by a person seated on a toilet.

FIG. 1 is a perspective view of one design of the invention in which a cover is pivotally attached to the tissue holder, so to take less effort when installing a fresh roll, by not require a separate handling of the cover.

FIG. 2 is a side view thereof shown in use.

FIG. 3 is a perspective view of another model of the invention that does not include a cover.

FIG. 4 is a view of a separate cover which could be fitted on the holder of FIG. 3, if so wished.

Referring now to the drawing in greater detail, and more particularly to FIGS. 1 and 2 thereof at this time, the reference numeral 10 represents a holder according to the present invention for storing an extra roll of toilet tissue 11 conveniently close by a conventional roll of tissue 12 being used in a bathroom or washroom by being supported on a freely rotatable spindle 13 on a wall 14 of the room.

In the present invention, a wire frame 15 includes a pair of hooks 16 for being hooked over opposite ends of the conventional spindle 13, each hook being at one end of a rod 17, the rods being parallel to each other and being connected by a cross rod 18 welded therebetween. An opposite end 16*a* of each rod is inwardly turned toward each other, in order that a second spindle

19 may be removably fitted therebetween for free rotation and on which the spare tissue roll 11 is fitted.

A cover 20, made either of rolled up sheet metal or molded plastic, is generally semi cylindrical in shape and includes a curved side wall 21 and opposite end walls 22. A rolled over edge 23 of the side wall serves as a hinge for being pivotally snap fitted around the cross rod 18. An opposite end edge 24 of the side wall may or may not include a lift tab 25 so to pivotally lift the cover when the spare roll 11 is wanted to be reached. Otherwise a straight continuous edge 24 can serve for the tissue paper to be torn off thereagainst. A lug 25 on each end wall edge serves for resting the cover against the rods 17 of the frame when the cover is downwardly pivoted.

The cover may be attractively decorated or be of a color that harmonizes with the room decor.

A modified design of holder 26 shown in FIG. 3 is the same as holder 10 except that it does not include the cover 20.

However, a separate cover 27 shown in FIG. 4, may be retailed separately for attachment to the holder 26 if so wished. The cover 27 may include (instead of the rolled over edge 23), a hole 28 on each end wall 22 so as to fit on the inwardly turned ends 18 of the frame, and thus be supported therefrom.

While various changes may be made in the detail construction, it is understood that such changes will be within the spirit and scope of the present invention as is defined by the appended claims.

What is claimed:

1. A holder for a spare roll of toilet tissue, comprising in combination a wire frame having hooks for hooking around a spindle of a conventional tissue roll that is in use, mounted in a recess of a wall, and a generally semi-cylindrical cover mounted pivotally on said frame for covering said spare roll and means for pivotally lifting said cover on said frame wherein said means include a cross rod on said frame, a rolled over edge on said cover being hinged on said cross rod, said frame further including parallel straight rods having said hooks at the inner end and turned in stubs at the outer end spaced from said cross rod to receive thereon a spindle for said spare roll, said straight rods extending from said hooks to said stubs at an angle to and spaced from the said wall, said cover further including tabs that abut said rods to provide clearance for the tissue.

* * * * *